United States Patent [19]

Hiraoka et al.

[11] 4,311,941

[45] Jan. 19, 1982

[54] THERMIONIC CATHODE SUPPORTING DEVICE

[75] Inventors: Hideo Hiraoka; Masaru Amemiya; Hirotoshi Hagiwara, all of Machidashi, Japan

[73] Assignee: Denki Kagaku Kogyo Kabushiki Kaisha, Tokyo, Japan

[21] Appl. No.: 105,488

[22] Filed: Dec. 20, 1979

[30] Foreign Application Priority Data

Jan. 23, 1979 [JP] Japan ..... 54-5581

[51] Int. Cl.[3] ..... H01J 1/16

[52] U.S. Cl. ..... 313/336; 313/270; 313/337; 403/146

[58] Field of Search ..... 313/270, 292, 336, 337, 313/341; 403/146

[56] References Cited

U.S. PATENT DOCUMENTS

| | | | |
|---|---|---|---|
| 1,414,737 | 5/1922 | Gulick | 403/146 |
| 2,917,333 | 12/1959 | Liesen | 403/146 |
| 3,668,457 | 6/1972 | Gardner et al. | 313/337 |
| 3,889,829 | 6/1975 | Dutton | 403/146 |
| 4,068,145 | 1/1978 | Nakagawa et al. | 313/336 |
| 4,143,292 | 3/1979 | Hosoki et al. | 313/336 |

*Primary Examiner*—Harold A. Dixon

*Attorney, Agent, or Firm*—Sughrue, Mion, Zinn, Macpeak & Seas

[57] ABSTRACT

A thermionic cathode supporting device which comprises an electroconductive member adapted to support a thermionic cathode tip and a tip supporting heaters which hold said tip, a pressing means for resiliently pressing the above mentioned members from the outside thereof. The device is so arranged that the pressing force is easily adjustable and can be miniaturized, and applicable for the various different types of cathode devices of an electron gun or the like.

13 Claims, 4 Drawing Figures

THERMIONIC CATHODE SUPPORTING DEVICE

BACKGROUND OF THE INVENTION

This invention relates to a thermionic cathode of an electron gun used in many instruments such as an electron beam lithography system and/or a scanning electron microscope and more particularly to an improvement of a supporting device which supports the thermionic cathode tip in a thermally and mechanically stable manner.

Conventionally, the thermionic cathode of a tungsten hairpin type has been used. In electron beam lithography and/or scanning electron microscoper, a cathode tip consisting of a crystallization of lanthanum hexaborides having the $caB_6$ type crystal structure supported by a pair of high anisotropic carbonaceous material in sandwiched manner at both sides is used.

A pair of heaters for supporting a cathode tip in a cathode device imparts heat of high degree to the thermionic cathode tip by a joule heat generated during energization to emit thermal electrons. The pair of heat generating support elements must not be thermally deformable and must keep their stable supporting ability and bring emitting ability of the thermionic cathode tip in such as lanthanum hexaboride, having the $caB_6$ type crystal structure.

FIG. 1 shows a sectional view of a conventional device for supporting a thermionic cathode such as disclosed in U.S. Pat. No. 4,068,145. In the thermionic cathode supporting device, an emitter tip 1 is held by a pair of heaters 2*a* and 2*b* which, in turn, are held by a pair of electroconductive members 3 and 4 formed in a fork shape. The arrangement is such that each of the tip supporting heaters 2*a* and 2*b* is pressed in a direction to oppose each other by spring members 9 and 10. At the ends of the electroconductive members 3 and 4, there are formed divided portions in a further fork shape. At the end of the each inner divided portions 3*a* and 4*a*, the cathode tip 1 and the pair of tip supporting heaters 2*a* and 2*b* are simultaneously held. The spring members 9 and 10 are mounted on the further outer portion of the outer sections 3*b* and 4*b* of the divided portions of the electroconductive members so as to press the tip supporting heaters 2*a* and 2*b* in a direction to hold the cathode tip 1. The spring members 9 and 10 are made of such material as molybdenum which maintains resilence or elasticity even in a high temperature and formed in a line or a strip piece. The pair of conductive members 3 and 4 tend to be easily heated when the cathode tip 1 is heated and therefore, the spring members 9 and 10 are fixed to the external surface of the conductive members 3 and 4 by screws 11*a* and 11*b* so that the spring members are free from being heated by the heat from the cathode tip 1 and the tip supporting heaters 2*a* and 2*b*. A pair of pressure elements 12*a* and 12*b* which are made of insulating material such as porcelain and are pressed by free ends of the spring members 9 and 10, pass through the through holes 30*a* and 30*b* formed in the outer divided portions 3*b* and 4*b* and are slidably supported in axial direction by support pieces. The arrangement is such that each of the spring members 9 and 10 presses the pressure element 12*a* and/or 12*b* in an axial direction of the cathode to press inner divided portions 3*a* and 4*a* which, in turn, hold the tip supporting heaters 2*a* and 2*b* and the cathode tip 1.

In the above described prior art thermionic cathode supporting device referring to FIG. 1 of the present application, the pair of spring members 9 and 10 are directly fastened to the conductive members 3 and 4 by screw members, and consequently, the heat in the conductive members 3 and 4 raises the temperature of the spring members 9 and 10. Thus, the spring members 9 and 10 lose their elasticity by the long time heating although their materials are not so influenced by heat. The loss of elasticity results in the variation of contact resistance between the tip supporting heaters and the cathode tip. The variation of the contact resistance, undesirably varies the temperature of the cathode tip 1. It is to be noted that the outer sections 3*b* and 4*b* of the divided portion of the conductive members 3 and 4 serve only as members for mounting the spring members 9 and 10 and as a slide guide thereof, but can not serve to prevent the heat radiation from the top portion of the cathode to the spring members 9 and 10. It is further to be noted that the spring members are formed in a manner to extend outwardly so that the cathode device becomes undesirably large in size. Normally, the electroconductive materials are heat conductive materials. Therefore, as the conductive members become larger in size, more heat is conducted, which results in more heat loss and requires more electric power. As disclosed hereinabove, holding the force of each of the tip supporting heaters 2*a* and 2*b* to support the emitter tip 1 is imparted by the spring members 9 and 10. However, in the arrangement, micro adjustment of the pressing force is not practicable.

SUMMARY OF THE INVENTION

An object of the present invention is to provide a thermionic cathode supporting device in which the conductive member is far smaller in size as compared to the conventional device to save electric power for heating.

Another object of the present invention is to provide a cathode supporting device in which a cathode of hexaboride having the $caB_6$ type crystal structure is applicable for various types of ready made socket such as the tungsten hairpin type cathode.

A still other object of the present invention is to provide a cathode supporting device in which both the micro adjustment of the pressing force to support the thermionic cathode tip and the position of the top of the cathode are easily practicable.

A still further object of the present invention to provide a cathode supporting device in which the pressing means are electrically insulated and thermally separated from the electroconductive members and the pressing force of the pressing means is not varied in due course of time.

A still other object of the present invention is to provide a cathode supporting device in which the materials for forming necessary parts of the device are easily obtainable and the manufacturing, assembling and adjustment are easily practicable and consequently, the manufacturing cost of the device is low.

The supporting device of the present invention comprises a thermionic cathode tip, tip supporting heater adapted to contact with both sides or circumference of the thermionic cathode, a pair of resilient or elastic and electroconductive members made of heat resisting metal and formed in a single plate or rod shape for holding the cathode tip and the heater at the sametime, and a pressing means to impart the pressing force to the above mentioned members. The pressing means comprises cylindrical heat resistive and electrically insulating members, bolts inserted together or separately into the insulating members, locking or retaining members fixed to or movably connected to the end of the bolts, and the pressing means consisting of spring members inserted between the retaining member and the insulating members.

In the present invention, the cathode tip is made of rare earth boride having the $caB_6$ type crystal structure such as lanthanum hexaboride. The tip supporting heater is made of anisotropic carbonaceous material such as pyrolytic graphite or glassy carbon. Further, the electroconductive member, bolts and the elastic members are made of metal with high melting point such as mentioned below. Desirably, the bolt is made of material which is easy machinable as in the case of the insulating members. Through holes are formed in symmetrical position of the pair of electroconductive members to insert the electrically and thermally insulating cylinder between the pair of conductive members and between the pressing means and the conductive members.

In the cathode supporting device of the present invention, an elastic member of the pressing means is not heated in such a degree to lose its elasticity although it is positioned in the vicinity of the conductive member since there is disposed a thermally insulating material between the elastic member of the pressing means and the conductive members. The spring members of the pressing means always maintain their elasticity to impart stabilized pressing force to the thermionic cathode tip and the tip supporting heaters for long periods and exclude variation of the current due to the variation of the contact resistance between the cathode tip and the tip supporting heaters. Further, the members of the pressing means are simple in their construction and connection of them is mechanically simple. Therefore, manufacturing, assembling and adjustment are easily and acculately accomplished. The size of the thermionic cathode tip and the tip supporting heater is varied according to the required capacity and the distance between the electrode is decided by the distance between sockets on the side of the source.

In order to provide an exchangeability to the cathode supporting device with the ready made device, the device must be arranged such that the distance between the conductive members is adjustable. The device according to the present invention disclosed in the embodiments given hereinbelow is easily adjustable.

PREFERRED EMBODIMENT

In the description, the parts identical to those of the conventional device are designated by identical symbols.

Figure 1:
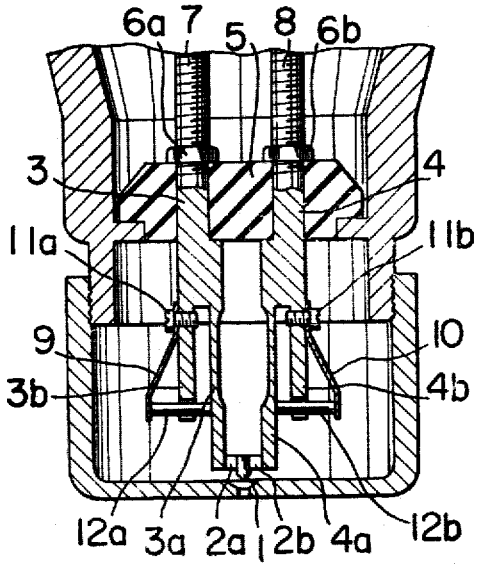
FIG. 1 PRIOR ART
FIG. 1 is a sectional view of a device for supporting a thermionic cathode prior art.
Figure 2:
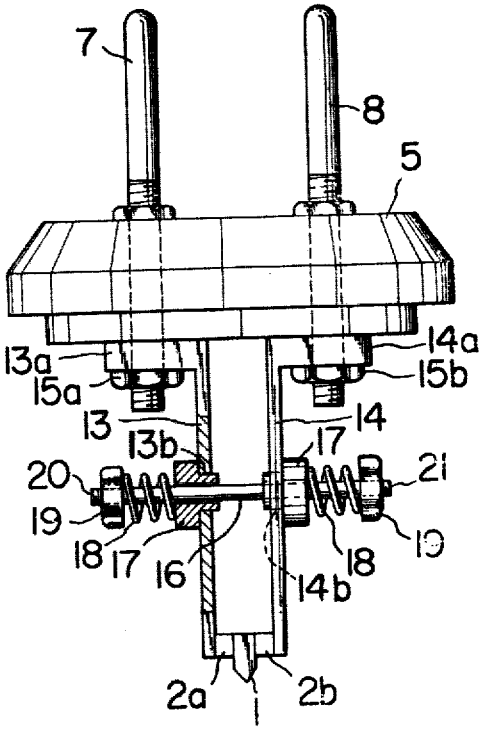
FIG. 2 is a partially broken elevational view of the thermionic cathode supporting device of the present invention.

Referring to FIG. 2 the device comprises a thermionic cathode formed as a thermionic emittable tip, a pair of tip supporting heaters 2*a* and 2*b* supporting the thermionic cathode tip 1, and a pair of heat resistive and resilent or elastic electroconductive members 13 and 14 holding the heaters 2*a* and 2*b* together with the thermionic cathode tip 1. The conductive members 13 and 14 of the present invention differ in shape from those of the conventional device shown in FIG. 1. For example, each of the conductive members of the present invention is formed as a flat plate or a rod and does not have divided portions as indicated in FIG. 1. Further, in the present invention, foot portions of the conductive members 13 and 14 are formed in L shape and fixed portions 13*a* and 14*a* contact with the surface of an insulating base 5. Electrodes 7 and 8 pass through the holes formed in the insulating base 5 and the fixed portions 13*a* and 14*a* and the tops of the electrodes 7 and 8 are tightly screwed by the nuts 15*a* and 15*b*. The conductive members 13 and 14 may be directly spot welded or silver soldered to the electrodes 7 and 8 (not shown). The pressing means are electrically and thermally insulated from each of the conductive members 13 and 14. In the other words, the pressing means comprise bolt 16, cylindrical insulators 17 having a flange, coil springs 18 and nuts 19 which serve as retaining members. As described hereinabove, each insulator 17 is cylindrical in shape and has a flange and a, its small diameter part the latter fitting in the through holes 13*a* and 14*b* formed adjacent the central portion of the conductive members 13 and 14. The bolt 16 passes through the central portions of the pair of the insulators 17. Each of the springs 18 is mounted to each end of the bolt 16. The nuts 19 are threadably engaged with the screwed portions 20 and 21 formed at the ends of the bolt 16. With the above mentioned arrangement, each of the springs 18 respectively presses each of the conductive members 13 and 14 via the insulators 17 to hold the thermionic cathode tip 1 and the pair of the tip supporting heaters 2*a* and 2*b* under a constant pressing force. The spring members 18 which serve as pressing force generating means, are electrically and thermally insulated by the insulators 17 from the conductive members 13 and 14. Therefore, in the device according to the present invention, there is not such problem as caused by the heat in the conventional supporting device. Preferably, mica formation, alumina, steatite and other machinable ceramic materials are used to form the insulators 17. In order to prevent the conduction of the heat, the insulators are desirably made as thick as possible using a ceramic which has a small heat conductivity. Desirably, material of the bolt 16 is ceramic to effectively prevent the rise of temperature in the spring 18. Preferably, the springs 18 are made of such materials as, for example, heat resistive nickel alloy, tungsten, molybdenum, INCONEL (a trademark of the International Nickel Co.), high speed steel, dies steel for hot working and steel for cold working 18-8 and stainless steel which maintain their elasticity even when heated in 400°-500° C. Instead of forming a pressing means by using the spring 18, another arrangement may be provided to impart the pressing force to the conductive members only by screwing the nuts 19. However, it is inconvenient in case that the conductive members 13 and 14 lose their conductivity with the rise of the temperature therewith because the holding force for holding the cathode tip and the tip supporting heaters depend on only the elasticity of the conductive members 13 and 14.

In the instant embodiment, only a single bolt 16 supports two springs 18 so that the pressing force imparted to the pair of conductive members 13 and 14 is balanced even when the pressing force imparted to one spring differs in heaviness from the pressing force which is imparted to another spring. Therefore, misalignment of the center of the thermionic cathode 1 is minimized and an unbalance of the contact resistance is suppressed even when the conductive members 13 and 14 are deformed by thermal stress.

Figure 3:
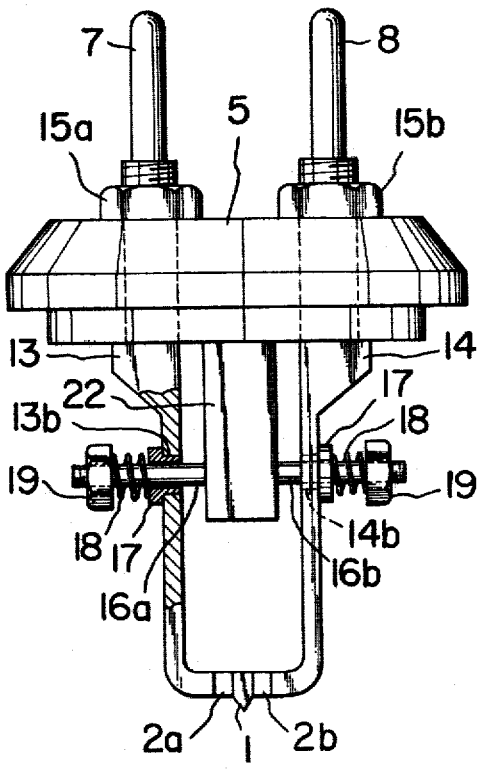
FIG. 3 is a partially broken elevational view of the thermionic cathode supporting device of another embodiment.

In the embodiment shown in FIG. 3, an insulating support member 22 is disposed between a pair of conductive members 13 and 14 and fixed to an insulating base 5. Stud bolts 16*a* and 16*b* are formed at both sides of the support member 22. Each of the springs 18 independently imparts elastic pressing force to the corresponding conductive member 13 or 14.

Each of the conductive members 13 and 14 has at one end a thick base portion which is formed in an L shape. The conductive members 13 and 14 cooperate with each other to hold the thermionic cathode tip 1 and the heaters 2*a* and 2*b*. The nuts 15*a* and 15*b* are disposed at different positions as compared with the embodiment shown in FIG. 2. In the instant embodiment, the bolts 16*a* and 16*b* are independently fixed to the insulating support member 22 so that the pressing force of each conductive member 13 or 14 against the thermionic cathode is separately adjustable. Further, alignment of the thermionic cathode can be completed by adjusting the elastic force of the springs 18. The insulating support member 22 may be formed integrally with the insulating base 5.

Figure 4:
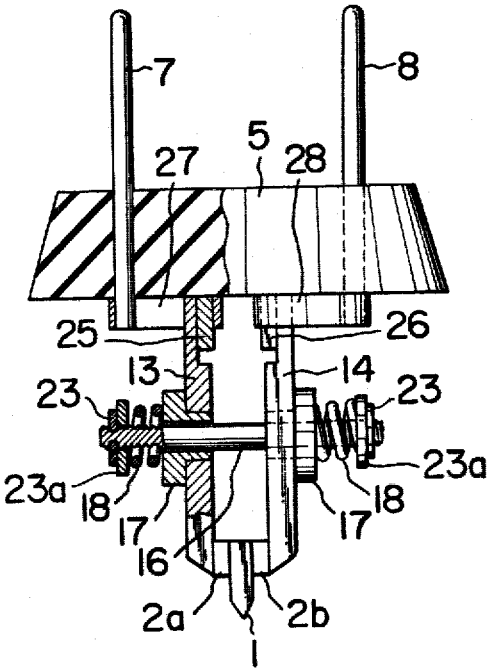
FIG. 4 is a partially broken elevational view of the thermionic cathode supporting device of still another embodiment.

In the embodiment shown in FIG. 4, the springs 18 are retained respectively at the end portion of the bolt 16 by the arrangement in which a groove or a stage portion is formed circumferentially at end portions of the bolt 16 and an E ring or end plate serving as a retainer 23 fits in the groove. In other words, the instant embodiment is a modification of the embodiment shown in FIG. 2. In the instant embodiment, the foot portions of the pair of conductive members 13 and 14 are made thin. The conductive members are spot welded at the thined portion of the foot portion to auxiliary struts 25 and 26 and further connected to the electrodes 7 and 8 by welding metal bands 27 and 28 formed in ring shape thereto.

The fixing means consisting of the stopper 23 of the instant embodiment is smaller in size and simpler in structure as compared to the fixing means operated by the nuts 19 and shown in FIG. 3. Further, the device of FIG. 4 can be formed smaller in size because the projection portion of the pressing means can be made small. Still further, thermal capacity of the device can be reduced by the arrangement. Therefore, the device is applicable to a conical Wehnelt which has a small inner capacity. The device of the instant embodiment has an exchangeability with conventional one of the electron microscope because the cathode is heated using power of less than 1.5 times as compared to the thermionic cathode with a tungsten hair pin type supporting device. Location alignment of the thermionic cathode to the distance between the electrodes with respect to the size of the cathode is carried out as given hereinbelow;

In the case of FIG. 2, it is carried by selection of the position of holes on the fixed portions 13*a* and 14*a* of the conductive members for receiving the electrodes.

In the case of FIG. 3, it is by adjustment of a length of level part of the curved portion of the conductive member.

In case of FIG. 4, it is by adjustment of the mounting portion of the auxiliary strut by changing a length of the ring shaped metal band.

Further in the case of FIG. 4, the conductive members can be connected to electrode terminals which have different distance. In this case, the auxiliary strut may be omitted if the band is durable enough to hold the conductive members.

What is claimed is:

1. A thermionic cathode supporting device comprising a pair of resilient electroconductive members of plate or rod type for simultaneously holding a thermionic cathode tip and a pair of tip supporting heaters contacted therewith, and a pressing means adapted to impart pressing force to said members from the outside thereof, said pressing means comprising a cylindrical heat resistive and electric insulator means having a flange portion and fitted into said pair of electroconductive members, bolt means passing through an aperture provided in said insulator, said bolt means having a longitudinal axis, a pair of retaining members mounted to the ends of said bolt means, and a pair of annular spring members disposed between said retaining members and said insulator, said annular spring members having longitudinal axis substantially coincident with said axis of said bolt means.

2. A supporting device according to claim 1, wherein said bolt means comprises a single bolt which passes through said cylindrical insulator means being, said cylindrical insulator means formed as a pair of cylindrical insulators, one fitted in each of said members, said bolt having threaded portions formed at the ends thereof, and said retaining members consisting of nuts for providing an adjustable pressing force to said spring members.

3. A supporting device according to claim 1, wherein said retaining members mounted to said bolt means are E rings.

4. A supporting device according to claim 1, further comprising an insulating support member fixed to an insulating base and positioned between said pair of electroconductive members and said bolt means comprising a pair of bolts, each of which passes through said cylindrical insulator and is attached to opposite sides of said insulating support member.

5. A supporting device according to claim 2, wherein said bolt is formed from ceramics.

6. A supporting device according to claim 1, wherein a foot portion of said electroconductive member is formed in L shape.

7. A supporting device according to claim 1, further comprising electrodes and a fixing band and an insulating base and wherein each said electroconductive member is rectilinear in shape and is connected by said fixing band to terminals of said electrodes disposed on said insulating base.

8. A supporting device according to claim 1, wherein the end portion of said electroconductive member is curved in L shape.

9. A supporting device according to claim 1, wherein said cathode tip is made of hexaboride having the $caB_6$ type crystal structure.

10. A supporting device according to claim 1, wherein said tip supporting heaters are made of anisotropic carbonaceous material.

11. A supporting device according to claim 1, wherein said tip supporting heaters are made of glassy carbon.

12. A thermionic cathode supporting device comprising a pair of resilent electroconductive members of plate or rod type for simultaneously holding a thermionic cathode tip and a pair of tip supporting heaters contacted therewith, and a pressing means adapted to impart pressing force to said members from the outside thereof, said pressing means comprising a cylindrical heat resistive and electric insulator means having a flange portion and fitted into said pair of electroconductive members, bolt means passing through an aperture provided in said insulator, said bolt means having a longitudinal axis, a pair of E ring retaining members mounted to the ends of said bolt means, and a pair of spring members disposed between said retaining members and said insulator, said spring members having longitudinal axis substantially coincident with said axis of said belt means.

13. A thermionic cathode supporting device comprising a pair of resilient electroconductive members of plate or rod type for simultaneously holding a thermionic cathode tip and a pair of tip supporting heaters contacted therewith, and a pressing means adapted to impart pressing force to said members from the outside thereof, said pressing means comprising a cylindrical heat resistive and electric insulator means having a flange portion and fitted into said pair of electroconductive members, bolt means passing through an aperture provided in said insulator, said bolt means having a longitudinal axis, a pair of retaining members mounted to the ends of said bolt means, and a pair of spring members disposed between said retaining members and said insulator, said spring members having longitudinal axis substantially coincident with said axis of said bolt means, an insulating support member fixed to an insulating base and positioned between said pair of electroconductive members; said bolt means comprising a pair of bolts, each of which passes through said cylindrical insulator and is attached to opposite sides of said insulating support member.

* * * * *